United States Patent [19]

Amonett

[11] Patent Number: 5,030,801

[45] Date of Patent: Jul. 9, 1991

[54] TIMING MECHANISM WITH MOMENTARY SWITCH

[75] Inventor: Daniel K. Amonett, Indianapolis, Ind.

[73] Assignee: Emerson Electric Co., St. Louis, Mo.

[21] Appl. No.: 572,860

[22] Filed: Aug. 27, 1990

[51] Int. Cl.[5] ..... H01H 43/10

[52] U.S. Cl. ..... 200/38 R; 200/38 A

[58] Field of Search ..... 200/35 R, 38 R, 38 A, 200/38 F, 38 FA, 38 FB, 38 B, 38 BA, 38 C, 38 CA, 39 R, 39 A

[56] References Cited

U.S. PATENT DOCUMENTS

| | | | |
|---|---|---|---|
| 3,431,372 | 3/1969 | Obermann | 200/38 A |
| 3,553,720 | 1/1971 | Brown | 200/38 R |
| 4,292,482 | 9/1981 | Smock et al. | 200/38 R |
| 4,307,270 | 12/1981 | Smock | 200/38 A X |
| 4,412,110 | 10/1983 | Wojtanek | 200/38 A X |
| 4,491,710 | 1/1985 | Smock | 200/38 R |
| 4,538,037 | 8/1985 | Amonett | 200/38 R |
| 4,560,846 | 12/1985 | Klopp et al. | 200/38 C X |
| 4,892,983 | 1/1990 | Bogda et al. | 200/38 R |

*Primary Examiner*—J. R. Scott

*Attorney, Agent, or Firm*—Robert F. Meyer

[57] ABSTRACT

A timing mechanism has a segmented shaft one segment of which carries a camstack while the other segment carries a drive member coupled to an actuator for a momentary switch. The actuator is coupled to the drive member such that the shaft is free to rotate independent of the actuator, with the actuator being restrained from rotation. The actuator moves axially in response to movement of the drive member to open and close the momentary switch. A positive snap action breaking of the electrical contacts of the momentary switch is achieved by holding the movable electrical contact of the switch to the actuator so that it positively disengages from the other contact when the actuator is positively indexed.

6 Claims, 2 Drawing Sheets

TIMING MECHANISM WITH MOMENTARY SWITCH

BACKGROUND OF THE INVENTION

The present invention relates to a timing mechanism utilizing a momentary switch.

Timing mechanism have been used in appliance for many years to control the functions of appliances such as washers, dryers, and dishwashers for example. In such applications it is sometimes necessary to incorporate a momentary switch to start the operation of the appliance. Indeed government regulations mandate the use of a "push to start" feature on dryer applications. Because of such demands the industry is constantly searching for improved momentary or push to start switches that are relatively inexpensive and easy to produce.

SUMMARY OF THE INVENTION

Accordingly there is provided a timing mechanism which in general comprises a housing, shaft means extending through the housing and a motor coupled to the shaft means for power driven rotation thereof, cam means carried by the shaft means and switch means responsive to a rotation of said cam means, the shaft means including first and second shafts with the second shaft being axially displaceable with respect to the first shaft, the first shaft fixedly carrying the cam means, spring biased coupling means coupling the first and second shafts together, a circular drive member carried by the second shaft, and a momentary switch means including an actuator including a circular plate axially fixed on the second shaft, and a contact bar carried by the circular plate, the circular plate having at least one peripheral ledge, the peripheral ledge carried on the circular drive member permitting the circular drive member to be rotated independent of the circular plate, and restraining means preventing rotation of the circular plate and the contact bar, an electrical contact carried by the contact bar and adapted to engage another electrical contact upon axial displacement of the second shaft.

DETAILED DESCRIPTION OF THE INVENTION

Figure 1:
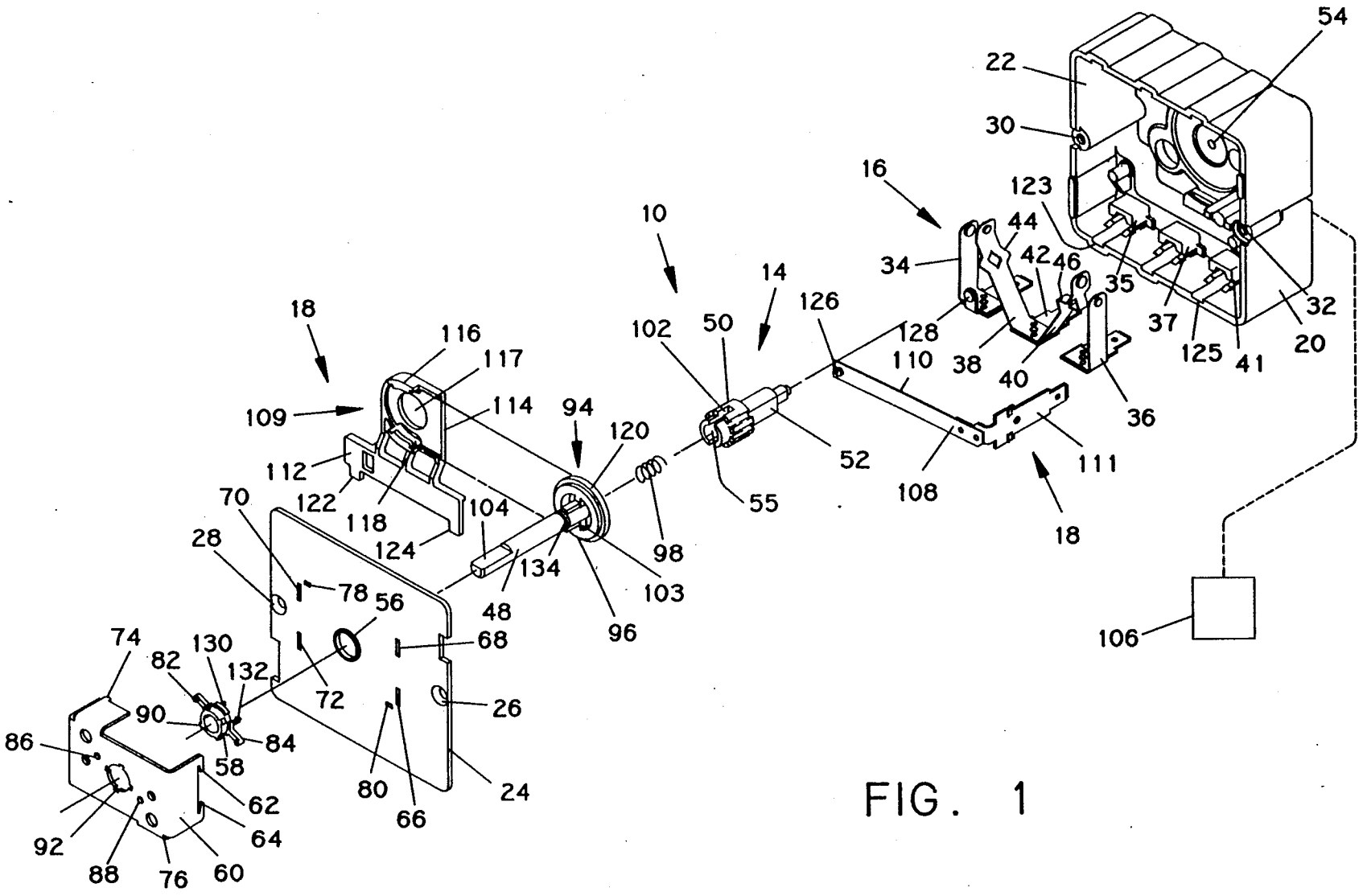
FIG. 1 is an exploded view of a timing mechanism utilizing the momentary push to start switch mechanism of the present invention.

Referring now to the drawings there is shown a timing mechanism 10 employing the features of the invention. Timing mechanism 10 includes a cam means 12 fixedly carried on a shaft means 14, switch means 16 which engage the periphery of the cam means to be opened and closed thereby, and a momentary switch means 18. These elements are carried within a housing which includes a cup shaped member 20 having an open end 22 that is closed by a cover plate 24. Cover plate 24 is held to the cup shaped member by screws (not shown) which extend through apertures 26 and 28 and which are threaded into sleeves 30 and 32. In the present embodiment, switch means 16 includes oppositely disposed fixed integral electrical contacts and electrical terminals 34 and 36 and movable electrical contacts 38 and 40 which are integral with electrical terminal 42. The movable electrical contacts engage cam means 12 through cam followers 44 and 46. As shown the integral electrical contacts and electrical terminals 34, 36, and 42 are carried by cup shaped member 20 through terminal blocks 35, 41, and 37 respectively.

Shaft means 14 includes an upper shaft 48 and a lower shaft 50. Lower shaft 50 fixedly carries cam means 12 on its double D portion 52. The lower shaft 50 is journalled in aperture 54 in the base of cup shaped member 20 and in aperture 56 of cover plate 24. Upper shaft 48 is journalled in aperture 55 of lower shaft 50 and a stabilizing bearing 58 which is held in place by bracket 60, the bracket being held to cover plate 24 through two oppositely disposed pairs of tangs 62 and 64 engaging slots 66, 68, 70, and 72 of the cover plate and also by tangs 74 and 76 engaging slots 78 and 80 in the cover plate. The stabilizing bearing 58 is held in place on the bracket 60 through fingers 82 and 84 engaging holes 86 and 88 and a plurality of tabs 90 engaging a corresponding plurality of notches 92.

Figure 2:
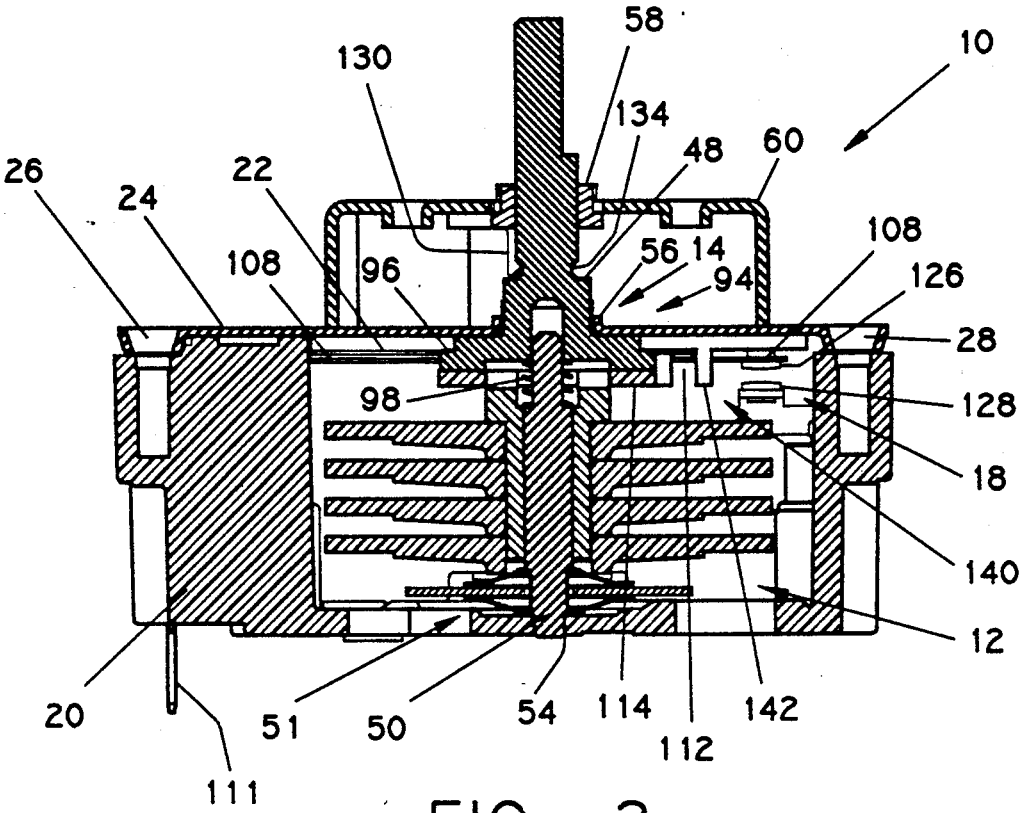
FIGS. 2 and 3 are cross sections of the timing mechanism, showing two different operating modes of the momentary push to start switch.
Figure 3:
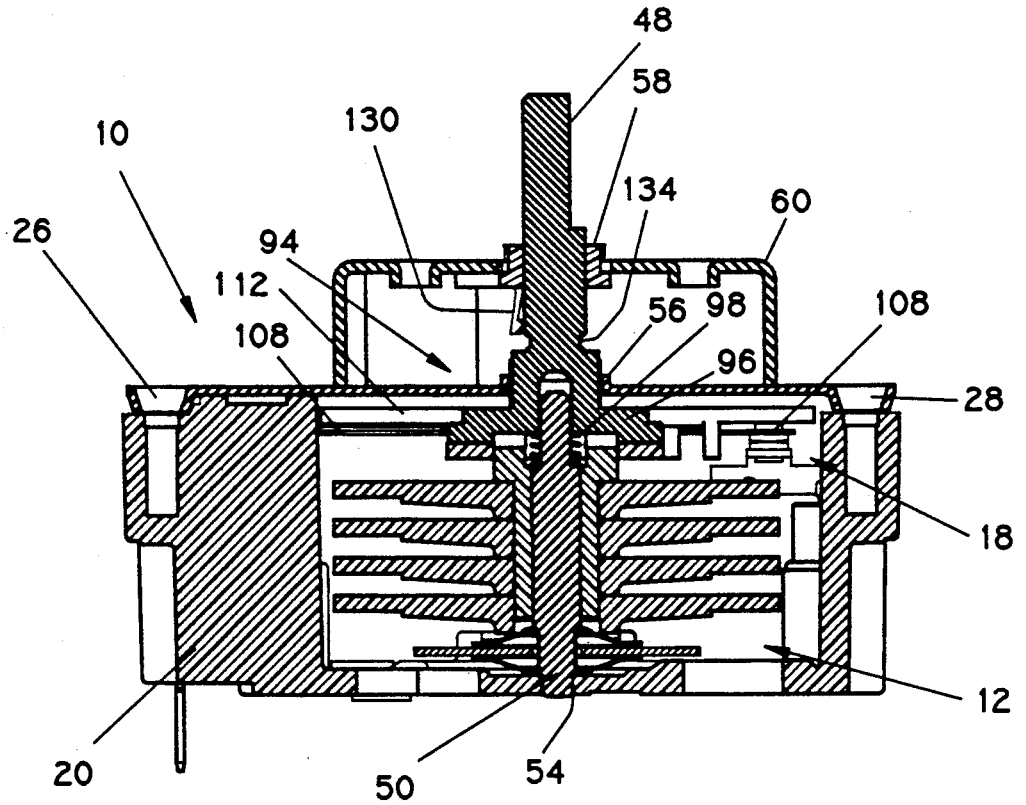

Upper shaft 48 and lower shaft 50 are coupled together by a coupling means 94 which includes a circular drive member 96, coil spring 98, and slot 102 provided in lower shaft 50. As best shown in FIGS. 2 and 3, coil spring 98 is carried on lower shaft 50 is biased between it and circular drive member 96. Circular drive member 96 includes spokes 103 which engage slot 102 in lower shaft 50. Upper shaft 48 carries a knob (not shown) on D portion 104 for manual operation while lower shaft 50 is coupled to a motor 106 through a clutch means 51 in a manner well known in the art.

Momentary switch 108 means 18 includes a switch and actuator 109. Switch 108 includes an integral electrical contact blade 110 and electrical terminal 111 and which is carried in cup shaped member 20. Actuator 109 includes a contact bar 112 that is coupled to upper shaft 48 through a semi circular plate 114 carried by the bar 112. Plate 114 includes oppositely disposed circular ledges 116 and 118 which fit over a flange 120 on drive member 96. The actuator 109 is retained on lower shaft 50 by the shaft being extended through a hole 117 provided in plate 114. The actuator's axial movement is controlled by the mating of circular ledges 116 and 118 of plate 114 with flange 120 of drive member 96. Its rotational movement is restricted by a pair of tabs 122 and 124 on contact bar 112 engaging a pair of slots 123 and 125 of cup shaped member 20.

Referring now to FIGS. 2 and 3, the operation of the device can now be described. In FIG. 2, the momentary switch is in the relaxed or disengaged position. Shaft means 14 has been rotated through the knob to rotate cam means 12 and close an electrical circuit to motor 106. When it is desired to start the appliance, upper shaft 48 is manually pushed in against the force of coil spring 98 and the force of the spring fingers 130 and 132 being ramped out of groove 134 thereby indexing actuator 109 axially to cause contact bar 112 to index "in" through drive member 96 and plate 114. The force of spring fingers 130 and 132 being ramped out of groove 134 provides a snap action feel. When contact bar 112 is indexed in, contact bar 112 engage electrical contact blade 110 causing electrical contacts 126 and 128 to close thereby completing an electrical circuit through integral electrical contact and electrical terminal 34 and electrical terminal 111. Such electrical circuit would start the appliance drive motor. In order to assure good alignment between contacts 126 and 128, contact bar 112 is guided through tabs 122 and 124 sliding in slots 123 and 125 provided in cup shaped member 20.

As shown in FIG. 3, upon manual release of upper shaft 48, the shaft springs back due to the action of coil spring 98 and actuator 109 is indexed "out" to open electrical contacts 126 and 128. In the "out" position of upper shaft 48 spring fingers 130 and 132 of stabilizing bearing 58 FIG. (1) engages groove 134 of the shaft.

During operation of the timing mechanism cam means 12 is allowed to rotate through the ability of drive member 96 to rotate within plate 114.

In momentary switch devices such as this it is essential, in order to prevent spurious arcing between electrical contacts 126 and 128, that the contacts be quickly and positively disengaged as a snap action when the momentary switch is disengaged. In the present embodiment this is accomplished by a positive contact breaking means 140. Positive contact breaking means includes a holding tab 142 extending from bar 112. Electrical contact blade 110 is carried between the bar and the tab. Thus when upper shaft 48 is manually released, coil spring 98 forces it and bar 112 with tab 142 to spring back and since contact blade 110 is carried between bar 112 and tab 142, the contact blade and thus electrical contact 126 will be quickly and positively disengaged from electrical contact 128.

What is claimed is:

1. A timing mechanism comprising:

a housing, shaft means carried in and extending through said housing and a motor carried on said housing and coupled to said shaft means for power driven rotation thereof, said shaft means including first and second shafts with said second shaft axially displaceable with respect to said first shaft, spring biased coupling means carried within said housing coupling said first and second shafts together, cam means fixedly carried on said first shaft within said housing and switch means carried within said housing engaging said cam means to be open and closed in response to rotation of said cam means, a circular drive member carried by said second shaft within said housing, and momentary switch means carried within said housing comprising an actuator including a circular plate fixedly carried on said second shaft and a contact bar carried by said circular plate, said circular plate having at least one peripheral ledge, said at least one peripheral ledge carried on said circular drive member to permit said circular drive member to be rotated independent of said circular plate, restraining means preventing rotation of said circular plate and said contact bar, and a first electrical contact engaged by said contact bar, and engaging a second electrical contact upon axial displacement of said second shaft.

2. A timing mechanism according to claim 1 wherein said restraining means includes a pair of tabs carried by said contact bar and engaging a pair of slots in said housing.

3. A timing mechanism according to claim 1 wherein said second shaft is journalled in said first shaft and a stabilizing bearing carried by and outside said housing and said coupling means includes at least one spoke in said circular drive member engaging a slot in said first shaft, and a coil spring carried on said first shaft and biased between it and said second shaft.

4. A timing mechanism according to claim 3 wherein said stabilizing bearing includes a pair of spring fingers engaging and disengaging a groove in said second shaft as it is axially displaced.

5. A timing mechanism according to claim 1 further including a positive breaking means disposed between said first and second electrical contacts and biased by movement of said second shaft to insure a quick positive break of said first electrical contact from said second electrical contact.

6. A timing mechanism according to claim 5 wherein said positive breaking means includes a tab extending from said contact bar and said first electrical contact is carried by a blade carried between said contact bar and said tab.

* * * * *